United States Patent [19]

Ökvist

[11] Patent Number: 4,784,761

[45] Date of Patent: Nov. 15, 1988

[54] DRUM SCREEN

[75] Inventor: Alf Ökvist, Skärblacka, Sweden

[73] Assignee: Kone-KMW AB, Örnsköldsvik, Sweden

[21] Appl. No.: 53,855

[22] PCT Filed: Sep. 18, 1986

[86] PCT No.: PCT/SE86/00420

§ 371 Date: May 18, 1987

§ 102(e) Date: May 18, 1987

[87] PCT Pub. No.: WO87/01624

PCT Pub. Date: Mar. 26, 1987

[30] Foreign Application Priority Data

Sep. 19, 1985 [SE] Sweden ..... 8504347

[51] Int. Cl.[4] ..... B07B 1/22

[52] U.S. Cl. ..... 209/294; 209/385; 209/664; 366/228

[58] Field of Search ..... 209/288, 293, 294, 290, 209/385, 393, 664, 683; 366/228, 229, 57, 58

[56] References Cited

U.S. PATENT DOCUMENTS

| | | | |
|---|---|---|---|
| 2,687,212 | 8/1954 | Kerr | 209/664 |
| 2,915,182 | 12/1959 | Burnet et al. | 209/288 |
| 4,018,675 | 4/1977 | Petrucci | 209/664 |
| 4,178,238 | 12/1979 | Harris | 209/284 |
| 4,535,895 | 8/1985 | Takiguchi et al. | 209/687 |
| 4,635,860 | 1/1987 | Kruyer | 209/294 |

FOREIGN PATENT DOCUMENTS

| | | | |
|---|---|---|---|
| 300441 | 7/1972 | Austria . | |
| 373510 | 1/1984 | Austria . | |
| 0975119 | 11/1982 | U.S.S.R. | 209/385 |
| 5924 | of 1888 | United Kingdom | 209/290 |
| 2151947 | 7/1985 | United Kingdom . | |

*Primary Examiner*—Robert B. Reeves
*Assistant Examiner*—Donald T. Hajec
*Attorney, Agent, or Firm*—Bell, Seltzer, Park & Gibson

[57] ABSTRACT

In order to enable thickness screening of the chips in a drum screen comprising a rotatable screen drum with screening slits (1) extending in circumferential direction and formed between a plurality of parallel rings (3) arranged one after the other and joined together at a predetermined distance from each other by means of cross pieces (4) extending axially on the inside of the rings (3), the invention suggests that at least a plurality of the rings (3) of the drum screen is provided with a plurality of guide plates (5) arranged along their inner circumference surfaces, substantially parallel to the screening slits (1) between the rings (3) in order to turn long splinters and chip pieces, enabling them to pass through the screening slits (1) intended for that particular chip thickness. The rings (3), as is known per se, consist of tubes or rods having radius cross section and bent to substantially circular shape. Furthermore the cross pieces (4) are formed as chip lifters extending in the direction towards the center-line of the rings.

14 Claims, 2 Drawing Sheets

DRUM SCREEN

The present invention relates to a drum screen comprising a rotatable screen drum with screening slits extending in circumferential direction and formed between a plurality of parallel rings arranged one after the other and joined together at a predetermined distance from each other by means of cross pieces extending axially on the inside of the rings.

In most chip screens the chips are sorted according to size. In this method screens are generally used having holes or apertures of suitable sizes to allow chips of a predetermined size to pass therethrough. The chips obtained are then treated in various ways. The largest chips are reduced to smaller pieces, medium-sized chips are utilized directly for pulp processes and the finest fraction, splinter-chips and undersize chips, is returned to the process or rescreened, the undersize chips then being utilized for combustion.

Another type of chip screens screen the chips according to thickness. This method results in superior chip quality and considerably higher yield from the economic point of view than screening according to size. The principal screens for thickness screening are known as disc screens and are either flat or V-shaped. In the flat disc screen the chips are fed forward by the rotary. movement of the discs. In the V-shaped disc creen the discs rotate perpendicular to the direction of movement of the chips. The difficulty with both these types, and also with other screens for thickness screening, has been to obtain and maintain a predetermined gap width between the movable machine elements so that no chips thicker than the gap can accompany the prime chips, i.e. those chips wich are thinner than the gap. Furthermore, prime chips often accompany the oversize chips which are returned for re-chipping. In both cases the economic value of thickness screening diminishes. AT 300 441 and AT 373 510 describe drums for sorting corn and squash seeds, respectively. The drums are constructed of a plurality of rings defining therebetween slits through which material can pass. However, the drums described would not be able to be utilized for thickness screening of chip material because of the fact that a great portion of prime chips would accompany the oversize chips which are returned for further chipping.

The object of the invention is to provide a drum screen having a screen drum of the type defined in the introduction which advantageously can be used for thickness screening of chip material. Thereby the invention will obtain said advantages associated with thickness screening such as superior chip quality and considerably higher yield from the economic point of view than screening according to size.

This object is obtained by the invention in that at least a plurality of the rings of the drum screen is provided with a plurality of guide plates arranged along their inner circumference surfaces, substantially parallel to the screening slits between the rings in order to turn long splinters and chip pieces, enabling them to pass through the screening slits intended for that particular chip thickness, that the rings, as is known per se, consist of tubes or rods having radius cross section and bent to substantially circular shape, and that the cross pieces are formed as chip lifters extending in the direction towards the centre-line of the rings.

The invention will be described further in the following with reference to the drawing.

Figure 2:
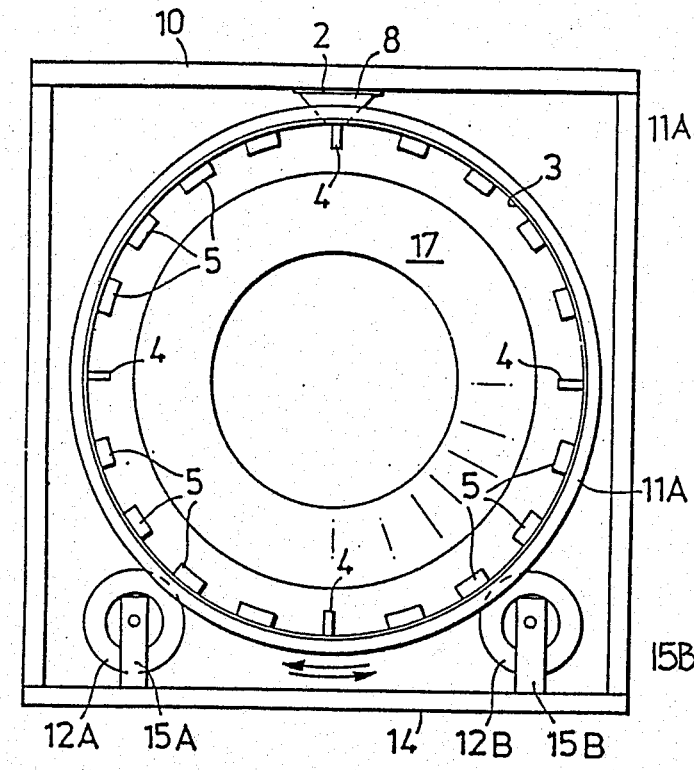
FIG. 2 is an end view of the drum screen according to FIG. 1 seen from the outlet end.
Figure 1:
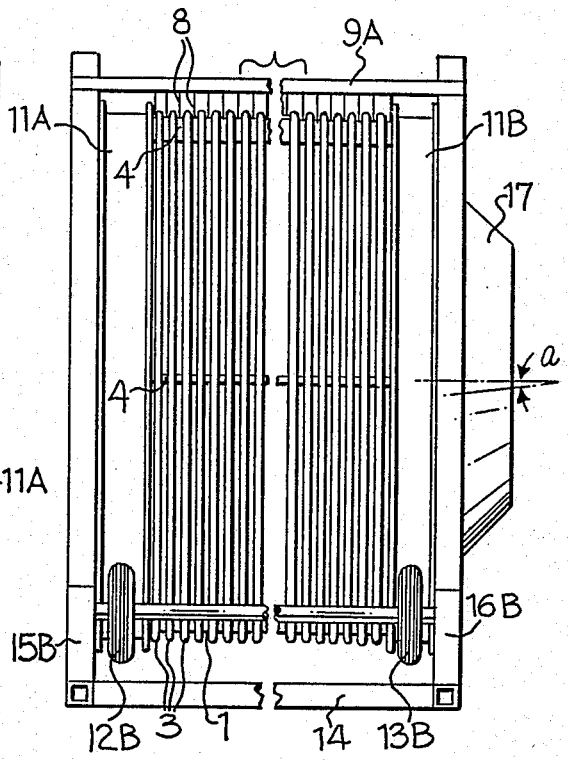
FIG. 1 is an elevational view of a drum screen according to an embodiment of the invention.

With reference to FIGS. 1 and 2 it is shown therein parts of a drum screen comprising a longitudinal rotatable screen drum being constructed of a plurality of parallel rings 3 arranged one after the other. The rings consist of tubes or rods having radius cross section and bent to substantially circular shape. In the embodiment shown the ring-forming tubes or rods have a circular cross section. Alternatively they can have an oval cross section. The rings 3 are perpendicularly located with respect to the rotation axis of the screen drum and are mutally joined together at a predetermined distance from each other by means of a plurality of cross pieces 4 attached to the inside of the rings 3 and extending axially thereon. The cross pieces 4 extend in the direction towards the centre-line of the ring and are formed as chip lifters. The number of cross pieces is suitably at least four. Thus, the chip lifters 4 have a predetermined radial extension such that they assist in spreading the chip material in the screen drum during its rotation.

The method in which the rings are secured will cause screening slits 1 to be formed between them having a predetermined width. The screening slits are narrow in relation to the diameter of the tubes or rods (or the greatest cross section dimension of oval tubes or rods). Thus, the screening slits extend in the circumferential direction of the screen drum.

Figure 5:
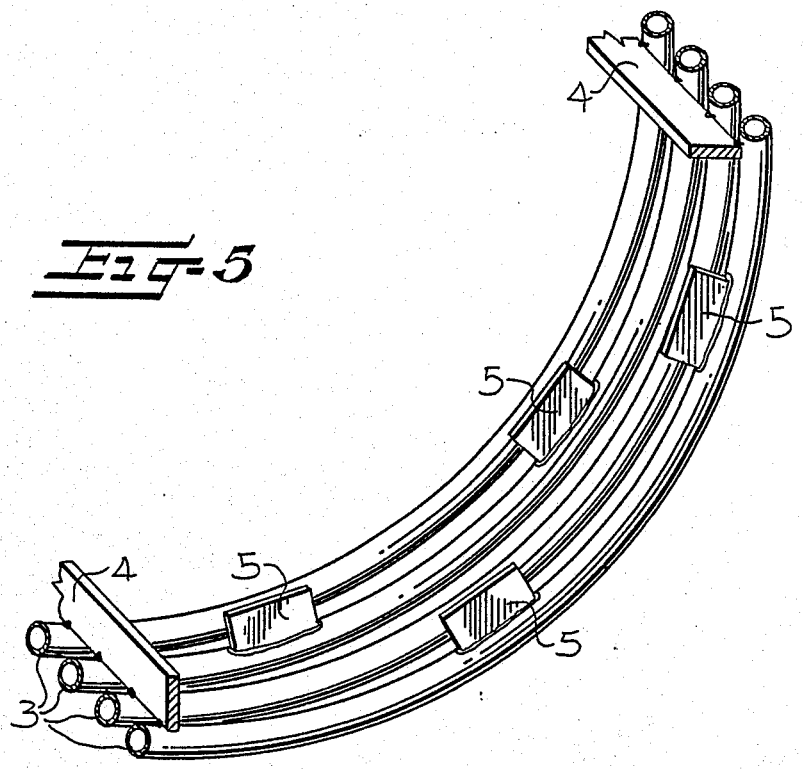
FIG. 5 shows a fragmentary perspective view of the drum screen according to one embodiment of the invention.
Figure 6:
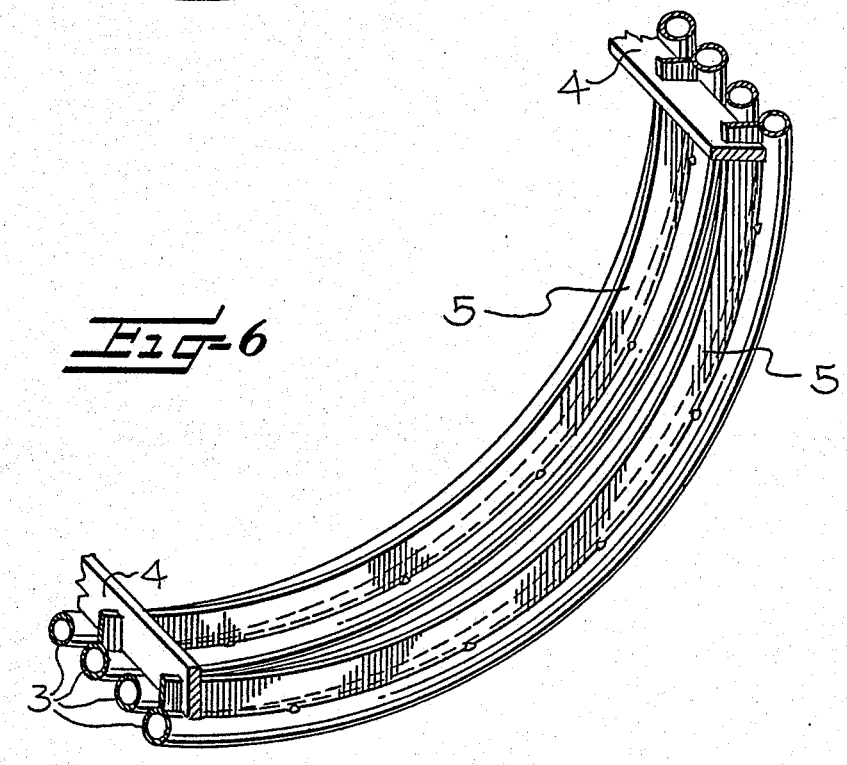
FIG. 6 shows a fragmentary perspective view similar to FIG. 5 but according to an alternative embodiment of the invention.

A plurality of guide plates 5 are attached on the inner side or inner circumference surface of the rings 3, in order to turn long, narrow splinters and chip pieces, enabling them to pass through the screening slits 1 intended for that particular chip thickness. In the embodiment particularly in FIG. 5 shown the guide plates 5 are arranged parallel to the screening slits 1. By mounting such guide plates on the inner surface of the rings 3 it is now possible to utilize the drum screen for thickness screening of chips. The guide plates 5 can be somewhat inclined, i.e. substantially parallel to the screening slits 1. According to a desirable embodiment they are mounted on every second ring. In the embodiment shown a plurality of shorter guide plates 5 are spaced from each other and mounted between two adjacent cross pieces 4. Alternatively, as shown in FIG. 6, each guide plate 5 can extend continuously between two adjacent cross pieces 4. In the first case the guide plates of one ring 3 can be displaced circumferentially with respect to the guide plates 5 of the following ring 3 being provided with guide rings.

The guide plates or chip turners 5 are also intended to slow down the flow of chips through the screen drum in order to prevent too high flow.

The screen drum formed by the many rings 3 is at each end provided with support rings 11A and 11B, respectively, attached to the screen drum. Each support ring 11A, 11B is journalled on a pair of wheels 12A, 12B, and 13A (not shown), 13B, respectively, in a rubber wheel unit 14 supporting a stand 10. At least one of the wheels, e.g. 12A, of said pair of wheels is a driving wheel, driven for instance by a motor (not shown) which is preferably reversible and which has constant or, if desired, variable drive speed allowing the direction and speed of rotation of the screen drum to be altered.

Figure 3:
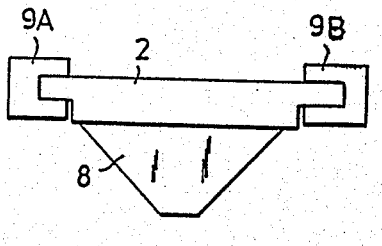
FIG. 3 shows parts of a clearing device of the drum screen according to FIGS. 1 and 2.

In the embodiment shown the drum screen comprises also a clearing device which is free or separate from the screen drum and its parallel rings 3 and support rings 11A and 11B, and is located outside the rings. As will be seen from FIG. 3 the clearing device comprises a plurality of clearing combs 8 applied on a holder 2 sliding in guiding means in the form of two tracks 9A and 9B secured to said stand 10 which is separate from the screen drum. The clearing combs 8 have a lower painted portion protruding into the screening slits 1 between the rings 3 (FIG. 1). The clearing combs 8 preferably may form an angle which is adapted to the diameter of the tubes or rods such that oversize chips which have caught in the screening slits 1 are pushed back into the screen drum formed by the rings 3.

Thanks to the drive motor, which may be a hydraulic motor, the rotary direction of the screen drum can be changed and its peripheral speed may also be adjusted.

The inclination a of the common geometric axis for the parallel rings 3 and screen drum can be adjusted, for instance by altering the level of the one pair of wheels 12A, 12B in relation to that of the other pair of wheels 13A (not shown), 13B. For this purpose each wheel may be supported, for instance, by an adjustable jack device 15A, 15B, 16A, 16B (not shown in detail).

In operation the drum screen is supplied with chip material through an inlet opening in the form of a funnel 17 mounted on one end of the screen drum. The chip material falls down to the bottom of the rotating screen drum where accepted chips, i.e. prime chips, pass through the screening slits 1 and are collected for further use, whereas rejected chips, i.e. oversize chips, are fed along by the rotary action of the screen drum and expelled through an outlet opening located at the opposite end of the screen drum to be processed further or rejected.

Figure 4:
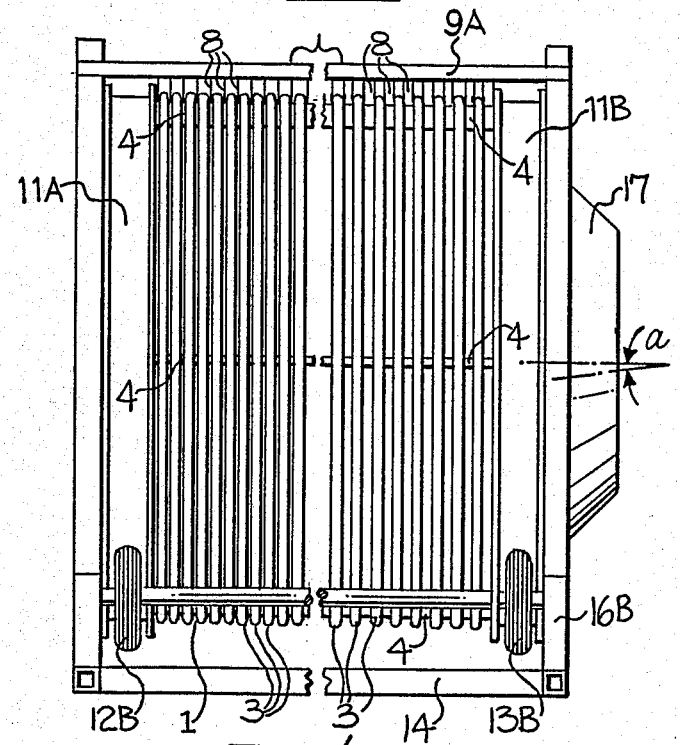
FIG. 4 shows an elevation of a drum screen according to an alternative embodiment of the invention.

Alternatively the drum screen may be designed only for thickness screening of chip material or in combination for separating splinter-chips and shavings or undersize chips from the chip material. In the latter alternat1ve, as shown in FIG. 4, the screen drum comprises a first section having narrower screening slits 1 for separating undersize chips and splinter-chips and a second section having wider screening slits 1 for the thickness screening of the chips, whereby said guide plates 5 are mounted in the second section. The dimension of the narrower screening slits 1 is usually between about 1.0 mm and about 2.0 mm, while the wider screening slits 1 have a d1mension which usually are between about 5.0 mm and about 8.0 mm.

The diameter and length of the screen drum, the height and number of the guide plates 5, the tolerance accuracy of the screening slits 1, the inclination of the drum screen or screen drum in relation to the horizontal plane, and the peripheral speed of the screen drum determine the capacity and selectivity of the thickness chip screen. The diameter actually selected for the tubes or rods forming the rings 3 should be in relation to the length of the pieces of the chip material being screened. Thus, for short pieces of material the tube or rod diameter should be small. Preferably the diameter of the tubes or rods would correspond to the length of the chip pieces.

I claim:

1. A drum screen for screening chips, including long splinters and chip pieces, said drum screen comprising a rotatable screen drum with screening slits extending in circumferential direction and formed between a plurality of parallel rings arranged one after the other and joined together at a predetermined distance fro each other by means of cross pieces which extend axially to the drum screen, characterized in that at least a plurality of the rings of the drum screen are provided with a plurality of guide plates arranged along their inner circumferential surfaces substantially parallel to the screening slits in order to turn long splinters and chip pieces enabling them to pass through the screening slits, the rings consists of tubes or rods bent to a substantially circular shape, and that the cross pieces comprise chip lifters extending in the direction towards the axis of the drum screen.

2. A drum screen according to claim 1, including a clearing device having clearing combs protruding into each of the screen slits, and guide means located on a stand separate from the screen drum for slidably receiving the clearing device.

3. A drum screen according to claim 1 or 2, characterized in that said guide plates are mounted on every second ring.

4. A drum screen according to claim 1, characterized in that the screen drum has at least four chip lifters evenly distributed therein.

5. A drum screen according to claim 4, characterized in that a plurality of guide plates are mounted in a spaced apart relation along each of said at least a plurality of the rings.

6. A drum screen according to claim 4, characterized in that each guide plate extends continuously between two adjacent chip lifters.

7. A drum screen according to claim 5, characterized in that the guide plates of a ring are displaced circumferentially with respect to the guide plates of the following ring provided with guide plates.

8. A drum screen according to claim 2, characterized in that the guide means consist of two parallel tracks.

9. A drum screen according to claim 1, in which each end of the screen drum is provided with a support ring secured to the screen drum and journalled by a pair of supporting wheels, at least one of the wheels of said pairs of wheels for one of the support rings being a driving wheel, characterized in that the driving wheel has a reversible, variable speed drive means allowing the direction and speed of rotation of the screen drum to be altered.

10. A drum screen according to claim 9, characterized in that the inclination of the common geometric axis of the rings and the screen drum is adjustable by altering the level of one of said pairs of wheels in relation to that of the other pair of wheels, each wheel being supported by an adjustable jack device.

11. A drum screen according to claim 1, characterized in that the width of the screening slits is small in relation ot the diameter or greatest cross section dimension of the tubes or rods.

12. A drum screen according to claim 1, characterized in that the screen drum has a first section with narrower screening slits to separate undersize chips and splinter-chips and a second section with wider screening slits for the acutal thickness screening of the chips, and wherein said guide plates are mounted in said second section.

13. A drum screen according to claim 12, characterized in that the screening slits of the first section have a dimension of etween about 1.0 mm and about 2.0 mm, and that the screening slits of the second section have a dimension of between about 5.0 mm and about 8.0 mm.

14. A drum screen according to claim 1, characterized in that the tubes or rods have a diameter or greatest cross section dimension which corresponds to the length of the chip pieces.

* * * * *

UNITED STATES PATENT AND TRADEMARK OFFICE
CERTIFICATE OF CORRECTION

PATENT NO. : 4,784,761

DATED : November 15, 1988

INVENTOR(S) : Alf Okvist

It is certified that error appears in the above-identified patent and that said Letters Patent is hereby corrected as shown below:

Column 1, line 27, after "rotary" delete the period (.).

Column 2, line 46, the word "shown" should be before the word "particularly" instead of after "FIG. 5".

Column 3, lines 48 and 49, "alternat1ve" should be -- alternative --.

Column 3, line 57, "d1mension" should be -- dimension --.

Column 4, line 10, "fro" should be -- from --.

Column 5, line 6, "etween" should be -- between --.

Signed and Sealed this

Twenty-seventh Day of June, 1989

*Attest:*

*Attesting Officer*

DONALD J. QUIGG

*Commissioner of Patents and Trademarks*